US012467222B2

(12) United States Patent
Mrozek et al.

(10) Patent No.: US 12,467,222 B2
(45) Date of Patent: Nov. 11, 2025

(54) UNIVERSAL MOUNTING STRUCTURE FOR EXCAVATOR ATTACHMENTS

(71) Applicant: Attach Acquisition Holdco LLC, Nashville, TN (US)

(72) Inventors: Brutger Mrozek, Bellingham, WA (US); Michael Howe, Bellingham, WA (US)

(73) Assignee: Attach Acquisition Holdco LLC, Nashville, TN (US)

( * ) Notice: Subject to any disclaimer, the term of this patent is extended or adjusted under 35 U.S.C. 154(b) by 289 days.

(21) Appl. No.: 18/218,777

(22) Filed: Jul. 6, 2023

(65) Prior Publication Data

US 2024/0102260 A1 Mar. 28, 2024

Related U.S. Application Data

(60) Provisional application No. 63/377,478, filed on Sep. 28, 2022.

(51) Int. Cl.
*E02F 3/36* (2006.01)

(52) U.S. Cl.
CPC ..... *E02F 3/3686* (2013.01)

(58) Field of Classification Search
CPC . Y10T 403/53; Y10T 403/55; Y10T 403/553; Y10T 403/7075; E02F 3/36; E02F 3/3686; E02F 3/3604; E02F 3/3609; E02F 3/3636; E02F 3/369; E02F 3/3622; E02F 3/96; E02F 3/966
See application file for complete search history.

(56) References Cited

U.S. PATENT DOCUMENTS 5,927,665 A * 7/1999 Grabnic ..... E02F 3/3604 403/4
6,364,561 B1 * 4/2002 Droegemueller ..... E02F 3/967 403/336
6,662,681 B2 12/2003 Crane
7,204,656 B2 4/2007 Bjuhr
(Continued)

FOREIGN PATENT DOCUMENTS

CA 2234893 A1 10/1999
GB 2429197 B 12/2007
WO 2009102223 A1 8/2009

*Primary Examiner* — Daniel J Wiley
(74) *Attorney, Agent, or Firm* — Manelli Selter PLLC; Edward Stemberger

(57) ABSTRACT

A universal mounting structure for changing attachments on a construction machine includes first and second ear plates mounted disposed in spaced relation. The ear plates include a first and second pair portions of elongated cutout patterns. First and second collar/pin assembly each includes a pin and a pair of collars. Each collar has an eccentric bore configured to removably receive each end of a pin and each collar has surfaces engaging complementary surfaces of one of the first or second pair portions of the elongated cutout patterns. The first and second collar/pin assemblies are configured such that a center distance between the pins can be adjusted 1) in large increments by moving either one or both of the first and second collar/pin assemblies within the respective pair portion of the elongated cutout patterns, and 2) in small increments by axial rotation of a pair of collars about a respective pin of one or both of the collar/pin assemblies.

20 Claims, 4 Drawing Sheets

(56) References Cited

U.S. PATENT DOCUMENTS

| | | | | |
|---|---|---|---|---|
| 7,770,311 | B2 | 8/2010 | Hahnel | |
| 8,020,324 | B2 | 9/2011 | Moser | |
| 8,579,084 | B2 * | 11/2013 | Becker | E04G 3/24 248/210 |
| 10,385,535 | B2 * | 8/2019 | Gonzalez | F16C 11/045 |
| 2012/0227246 | A1 | 9/2012 | Dawson | |
| 2018/0135271 | A1 * | 5/2018 | Gonzalez | E02F 3/3613 |
| 2021/0270005 | A1 * | 9/2021 | Kollmann | E02F 3/3636 |
| 2022/0090346 | A1 * | 3/2022 | Linden | E02F 3/364 |
| 2024/0133150 | A1 * | 4/2024 | Eggle | E02F 3/3686 |

* cited by examiner

UNIVERSAL MOUNTING STRUCTURE FOR EXCAVATOR ATTACHMENTS

FIELD

The present invention relates to mounting an attachment or implement to an operating arm of an excavator or other earth moving machine and, more particularly, to a universal mounting structure configured to allow adjustment between the differing measurements that occur with pins on the mounting structures and attachment to the earth moving machine using a Pin On or Pin Grabber style coupler.

BACKGROUND

Mounting structures for excavator attachments have a wide variety of sizes and dimensions for fitment. For both aftermarket and OEM applications, this creates difficulties in selecting the correct mounting structure to couple buckets or other attachments with the operating arm of an excavator or other earth moving equipment. Mounting structures that have two machined pins to attach the bucket or other attachment to the excavator machine, via a Pin Grabber style coupler, are all very similar in nature, and only differ in the dimensions of the diameter of the pins, the mounting width, and center distance between the pins. Custom mounting structures have to be made currently for each variation in each of these sizes, and are not adjustable to fit other machines that have different measurements.

There is a need for a universal mounting structure that is configured in such a way to allow adjustment between the differing measurements that occur with pins on the mounting structures and attachment with a Pin Grabber style coupler.

Pin On and Pin Grabber style couplers so that on one mounting structure, the pin diameter, the mounting width, and the center distance between the pins can each be adjusted.

SUMMARY

In accordance with an aspect of an embodiment, a universal mounting structure for changing attachments or implements on a construction machine includes first and second ear plates mounted to a base and disposed in spaced relation. Each ear plate includes at least one elongated cutout pattern. The elongated cutout patterns of the first and second endplates are aligned to define spaced first and second pair portions of the elongated cutout patterns. A first collar/pin assembly includes a first pin having opposing ends, and a first pair of collars. Each collar has an eccentric bore configured to removably receive an associated end of the first pin and has surfaces configured to engage complementary surfaces of the first pair portion of the elongated cutout patterns. The first pin extends between the first and second ear plates and within the first pair portion of the elongated cutout patterns, with surfaces of each collar being engaged with the complementary surfaces of the first pair portion of the elongated cutout patterns. A second collar/pin assembly includes a second pin having opposing ends, and a second pair of collars. Each collar of the second pair has an eccentric bore configured to removably receive an associated end of the second pin and has surfaces configured to engage complementary surfaces of the second pair portion of the elongated cutout patterns. The second pin extends between the first and second ear plates and within the second pair portion of the elongated cutout patterns, with surfaces of each collar of the second pair being engaged with the complementary surfaces of the second pair portion of the elongated cutout patterns. The first and second collar/pin assemblies are configured such that a center distance between the first pin and second pin can be adjusted in large increments by moving either one or both of the first and second collar/pin assemblies within the respective pair portion of the elongated cutout patterns. The first and second pairs of collars are configured such that the center distance between the first pin and second pin can be adjusted in small increments by axial rotation of a pair of collars about a respective pin of one or both of the collar/pin assemblies.

Of course, the invention should not be limited to the specific structure shown in the drawings or described herein. The structural and functional benefits of the present invention will be apparent to those of skill in the art when viewed in light of the following description and the accompanying drawings, which are not intended to limit the scope of the invention.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION OF EXEMPLARY EMBODIMENTS

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
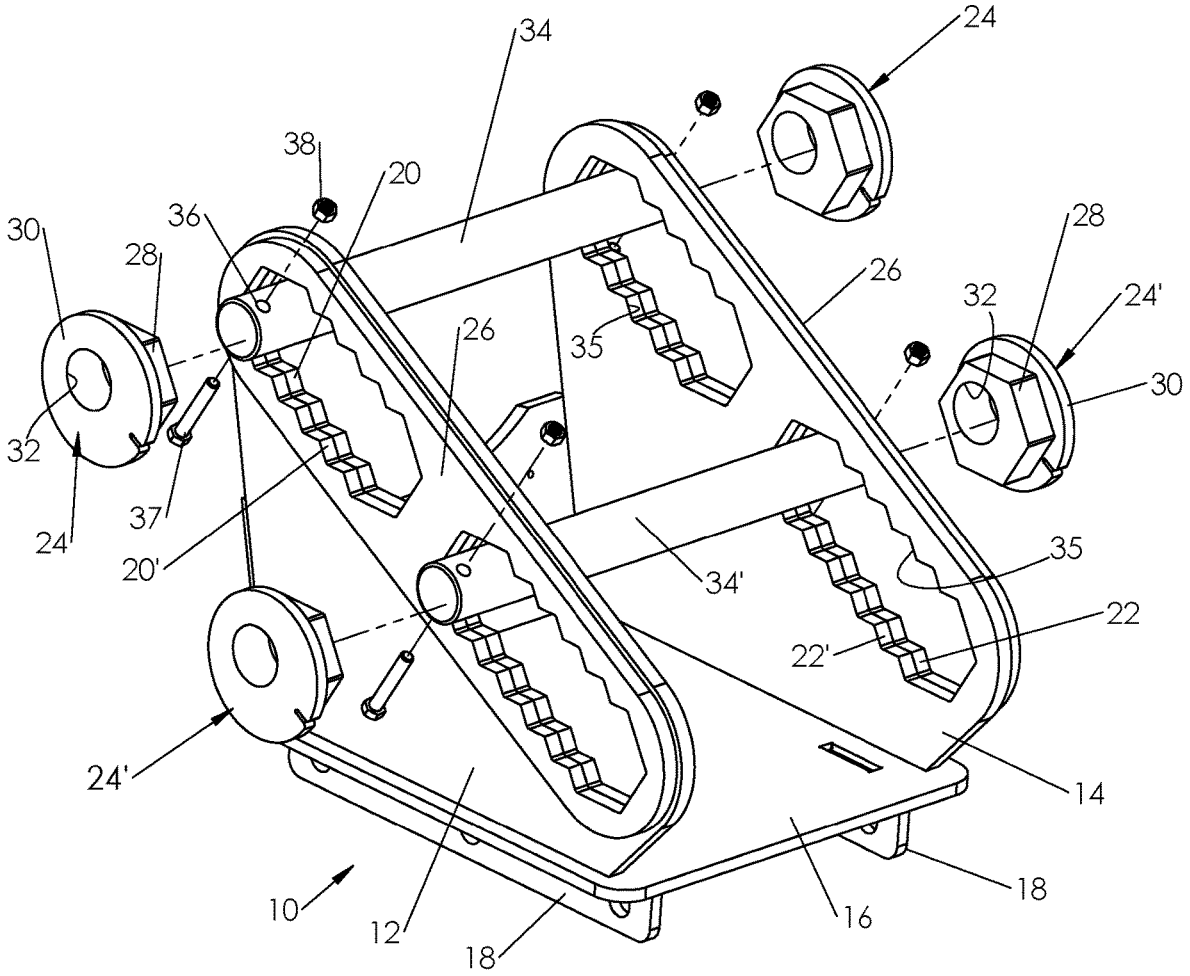
FIG. 1 is an exploded front perspective view of a universal mounting structure in accordance with an embodiment.

FIG. 1 is an exploded front perspective view of a universal mounting structure, shown generally indicated at 10, in accordance with an embodiment of the invention. The universal mounting structure 10 is configured for changing attachments on a construction machine using Pin On and Pin Grabber style couplers. The mounting structure 10 includes a first ear plate 12 and a second ear plate 14, disposed in spaced relation. Each ear plate 12, 14 is mounted on a base 16. In the embodiment, the base 16 is generally planar plate having a pair of mounting members 18 configured for removably mounting, by fasteners or the like, the mounting structure 10 to an attachment (not shown) such as an excavator bucket or other implement or attachment that the user wants to connect to. Instead of providing the mounting members 18, it can be appreciated that the base 16 can be an integral part of the attachment or implement (e.g., a top portion of a bucket). A reinforcing bridge plate 19 is fixed to the base 16 and extends between and is fixed to the first and second ear plates 12, 14.

The width between the ear plates 12, 14 is defined to account for all sizes of couplers within a desired range. Each ear plate 12, 14 includes first and second elongated cutout patterns, 20, 22, respectively, that facilitate movement and adjustment of collars 24 and thus pins 34, 34' as will be explained below. In the embodiment, the first and second elongated cutout patterns 20, 22 are individually defined and separated, but they can be configured as a single elongated cutout pattern in each ear plate 12, 14. The elongated cutout pattern 20 of the first ear plate 12 aligns with the elongated cutout pattern 20 of the second ear plate 14 to define a spaced first pair portion of the elongated cutout patterns 20 and the elongated cutout pattern 22 of the first ear plate 12 aligns with the elongated cutout pattern 22 of the second ear plate 14 so as to define a spaced second pair portion of the elongated cutout patterns 22. The first pair portion of the elongated cutout patterns 20 is configured to receive pin 34 and the second pair portion of elongated cutout patterns 22 is configured to receive pin 34" (FIG. 1).

An optional support member 26 is fixed to each ear plate 12, 14 and each support member 26 has first and second separated cutout patterns, 20', 22', respectively, that correspond to the cutout patterns 20, 22 of each ear plate 12, 14. The support members 26 provide a doubled wall with each ear plate 12, 14 at the high stress area of the cutout patterns 20, 22. The support member 26 can be considered to be part of the associated ear plate.

Figure 2:
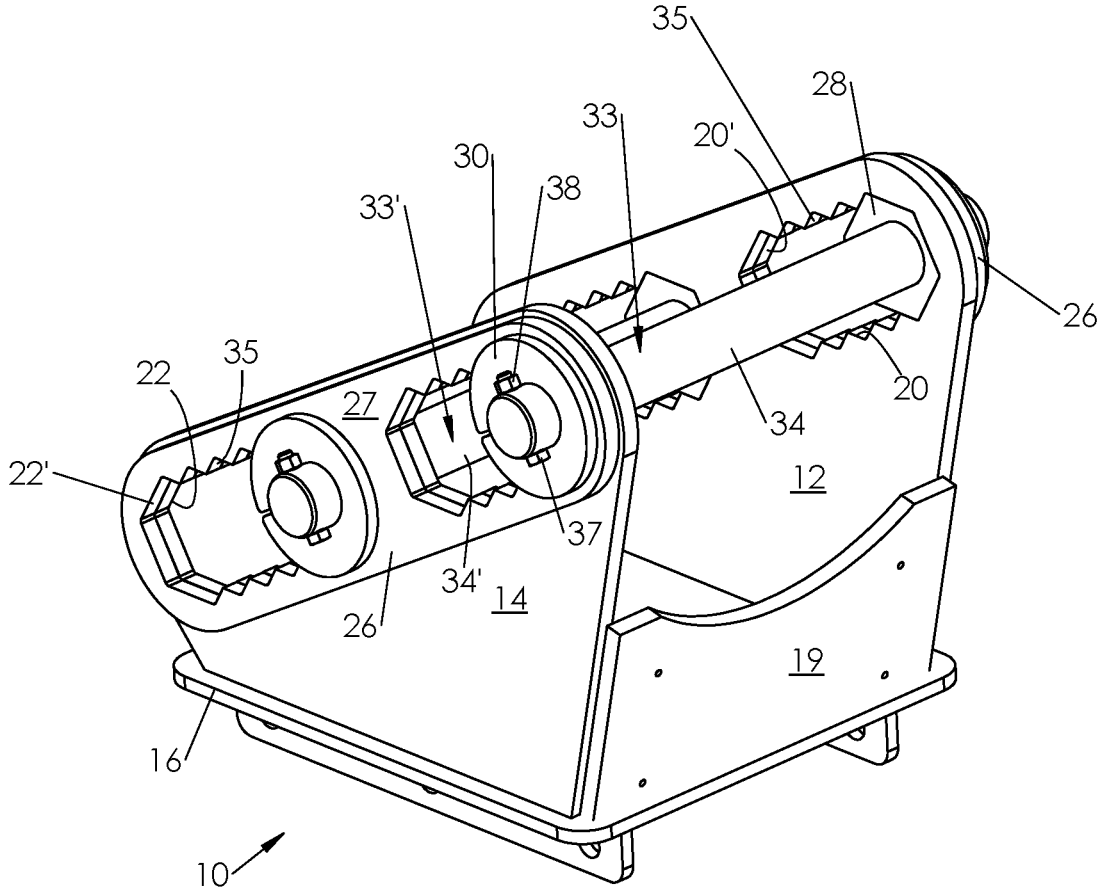
FIG. 2 is an assembled rear perspective view of the universal mounting structure of FIG. 1.
Figure 3:
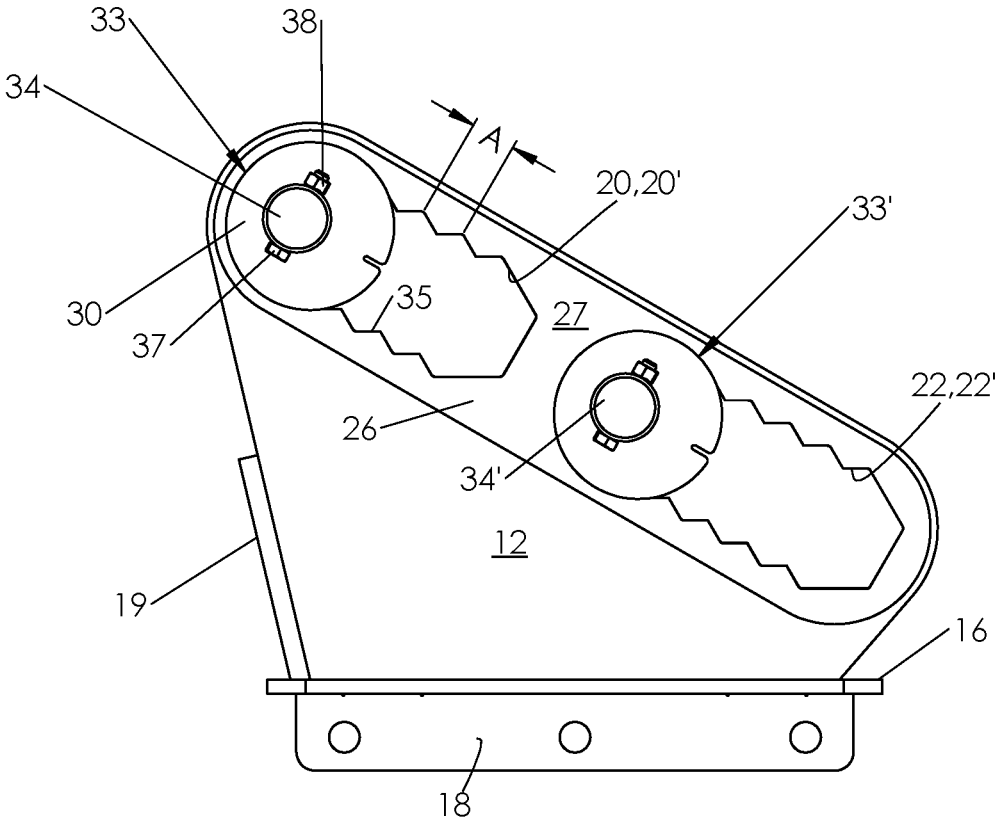
FIG. 3 is a left side view of the universal mounting structure of FIG. 1 assembled to define a certain spacing between pin centers.
Figure 4:
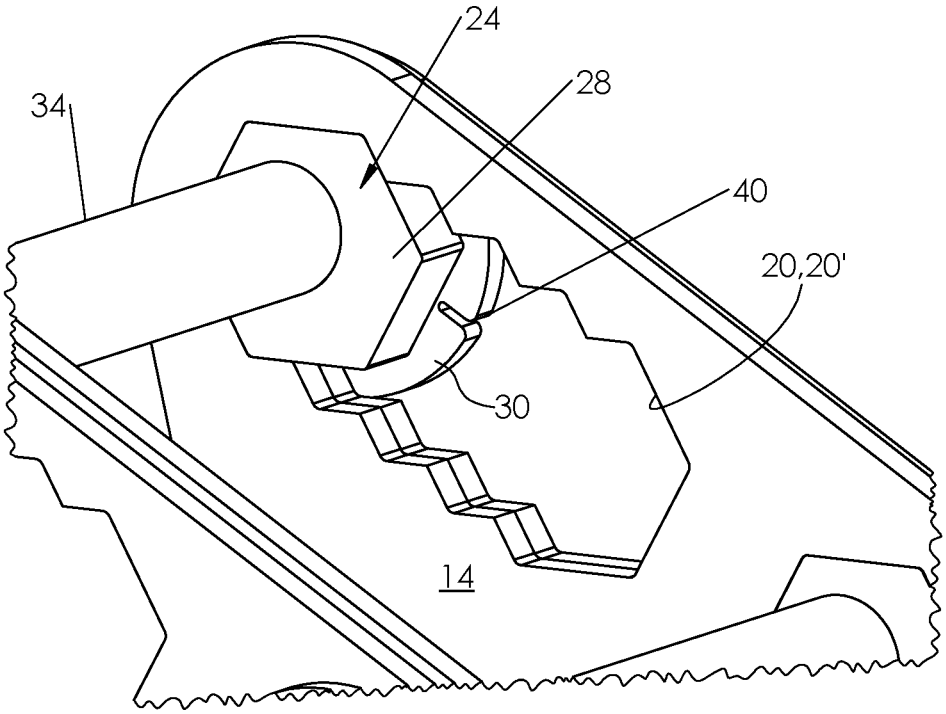
FIG. 4 is partial perspective view of a collar holding a pin, with the collar locked with surfaces defining a cutout in an ear plate.

As best shown in FIG. 1, in the illustrated embodiment, each collar 24, 24' has a hexagonal portion 28 and an endcap 30 integral therewith. An eccentric bore 32 extends through the hexagonal portion 28 and endcap 30. Each eccentric bore 32, in the same eccentric orientation, removably receives an end of a pin 34, 34' to define a collar/pin assembly, generally indicated at 33 and 33' in FIG. 2. Each end of each pin 34, 34' has a bore 36 therethrough that is transverse with respect to the pin axis. In the embodiment, a fastener 37, in the form of a bolt, extends through each bore 36 (FIG. 1) and is secured by a nut 38 so that the pins 34, 34' and attached collars 24, 24' have limited axial movement due to a surface of the end caps 30 engaging an external surface 27 of the support member 26 (FIGS. 3 and 4). The outer surface 27 of each support member 26 can be considered an outer surface of an associated ear plate 12, 14. Instead of providing the bolts and nuts, each fastener 37 can be a removal pin, set screw or the like, or other structure that can prevent axial movement of the collar/pin assemblies 33 and 33'.

The pins 34, 34' are configured to be long enough to extend in parallel relation between the ear plates 12, 14. The diameter of the pins 34, 34' used can vary as needed to accommodate what is needed for a particular machine. This can be done by making completely different diameter pins 34, 34' and collars 24, 24', or by using one size collar 24, 24' and sizing down the end of each pin 34, 34' to fit that collar, or by using sleeves (not shown) over the pin 34, 34' to change the effective diameter of the pin where it is being grabbed by the machine. A mounting width can be adjusted by use of spacers or locking collars (not shown) that slide onto the pins 34, 34' and take up extra space between the ear plates 12, 14 and the desired mounting width.

Thus, the first collar/pin assembly 33 comprising the first pin 34 having opposing ends, and a first pair of collars 24. Each collar 24 has the eccentric bore 32 removably receiving an associated end of the first pin 34. The pin 34 extends between the first and second ear plates 12, 14 and within the first pair portion of elongated cutout patterns (item 20 of ear plates 12, 14), with surfaces of each collar 24 being engaged with the complementary surfaces 35 of the first pair portion of elongated cutout patterns. In addition, the second collar/pin assembly 33' comprises the second pin 34' having opposing ends, and a second pair of collars 24'. Each collar 24' of the second pair has the eccentric bore 32 removably receiving an associated end of the second pin 34'. The pin 34' extends between the first and second ear plates 12, 14 and within the second pair portion of elongated cutout patterns (item 22 of ear plates 12, 14), with surfaces each collar 24' being engaged with the complementary surfaces 35 of the second pair portion of elongated cutout patterns.

With reference to FIGS. 3 and 4, the plurality of surfaces 35 of the cutout patterns 20, 22 (in ear plates 12, 14), and 20', 22' (in support plates 26) are configured to engage and lock with a surfaces of the hexagonal portion 28 of each collar 24 to facilitate large adjustment increments of each collar/pin assembly 33, 33' and thus large adjustment of the center distance between the two pins 34, 34'. In the embodiment, the surfaces 35 are generally sawtooth features to complement the surfaces of the hexagonal portion 28 of the collar 24, 24'. Due to the sawtooth cutout patterns, 20, 22, 20', 22' shaped to complement the hexagonal portion 28 of the collars 24, 24', in the embodiment, 40 mm incremental adjustments can be made (dimension A in FIG. 3). FIG. 3 shows the collar/pin assemblies 33 and 33' mounted in one of variable positions.

Figure 5:
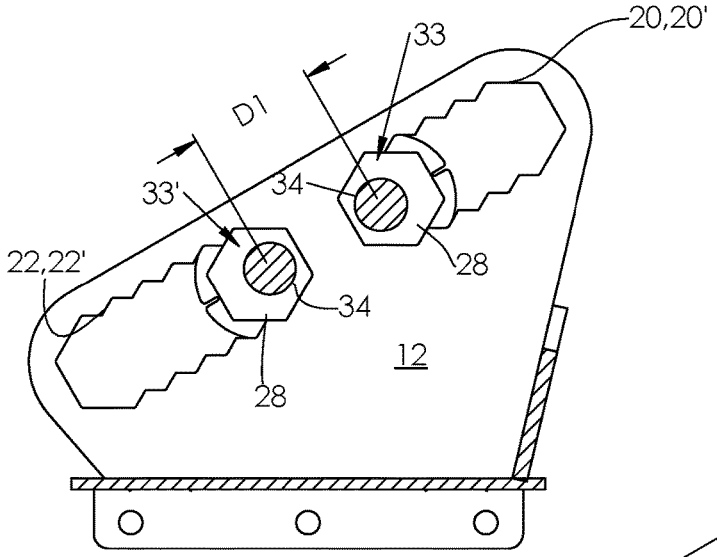
FIG. 5 is sectional view along the center of the universal mounting structure of FIG. 2 showing the collar/pin assembles disposed such that the pin center distance is at a minimum.
Figure 6:
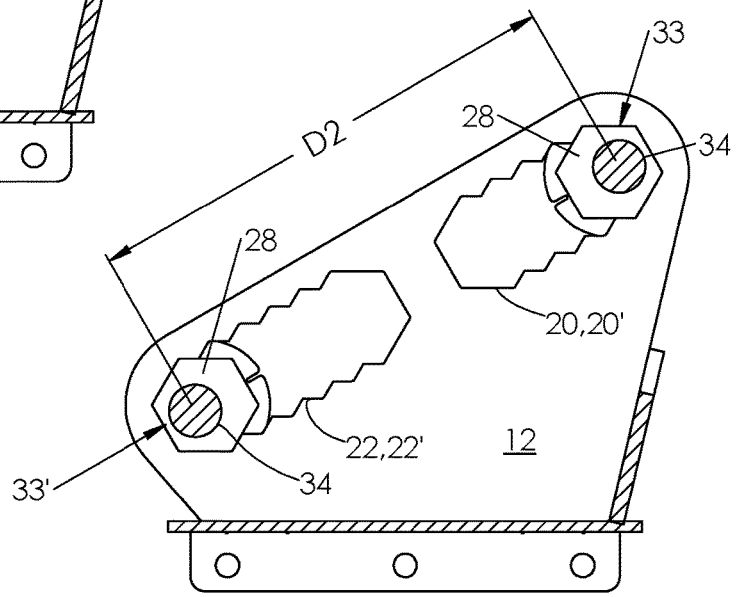
FIG. 6 is sectional view along the center of the universal mounting structure of FIG. 2 showing the collar/pin assembles disposed such that the pin center distance is at a maximum.
Figure 7:
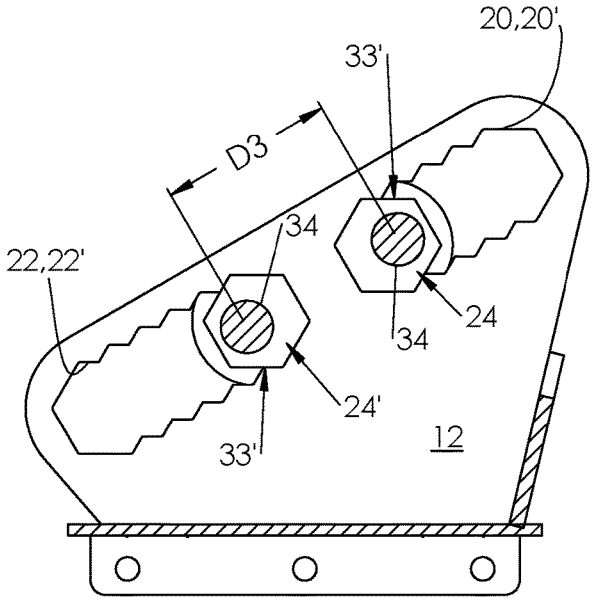
FIG. 7 is sectional view along the center of the universal mounting structure of FIG. 2 showing the collar/pin assembles rotated such that the pin center distance is slightly greater than minimum.

With reference to FIGS. 5 and 6 it can be appreciated that the collar/pin assemblies 33, 33' can be moved with respect to the cutout patterns 20, 20', 22, 22' between 1) a minimum center distance D1 between pins 34, 34' (FIG. 5) and 2) a maximum center distance D2 between pins 34, 34' (FIG. 6). Since each pin bore 32 is eccentric (offset from a center of each collar 24), fine adjustment (e.g., 10 mm) of the center distance between the two pins 34, 34' can be made by rotation of the collars 24 of one or both collar/pin assemblies 33, 33'. With reference to FIG. 7, although the collar/pin assemblies 33, 33' are engaged with the cutout patterns 20, 20', 22, 22' in the same position as in FIG. 5, due to rotation of the collars 24, 24' of both collar/pin assemblies 33, 33', a slightly greater center distance D3 results between the pins 34, 34'. Thus, rotation of the collars 24, 24' about their axes in each mounting position, allows the pin center distance D to be fine-tuned within each position. The collars 24, 24' can then be locked in the elongated cutout patterns and the pins 34, 34' can be secured using, e.g., the fasteners 37 and nuts 38.

The collar/pin assemblies 33, 33' can be assembled easily with simple tools. Also, the endcap 30 of each collar 24, 24' has a direction indicator 40 (FIG. 3) to ensure proper orientation of the collar/pin assemblies 33, 33'.

The collars 24, 24' can be made from variety of shapes, and a polygonal (e.g., hexagonal) collar shape is shown. The shape is not limited to a hexagonal shape and could be circular or oval, square, triangular, octagonal, another geometric shape, or even a non-Euclidean shape, with the elongated cutout patterns 20, 22, 20', 22', having a complementary shape.

The universal mounting structure 10 is thus configured to allow adjustment between the differing measurements that occur in Pin On and Pin Grabber style couplers. This ensures that on one mounting structure 10, a user can adjust the pin diameter, the mounting width, and the center distance between the pins.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A universal mounting structure for changing attachments or implements on a construction machine, comprising:

first and second ear plates mounted to a base and disposed in spaced relation, each ear plate including at least one elongated cutout pattern, the elongated cutout patterns of the first and second ear plates being aligned to define spaced first and second pair portions of the elongated cutout patterns, a first collar/pin assembly comprising a first pin having opposing ends, and a first pair of collars, each collar having an eccentric bore configured to removably receive an associated end of the first pin and having surfaces configured to engage complementary surfaces of the first pair portion of elongated cutout patterns, the first pin extending between the first and second ear plates and within the first pair portion of the elongated cutout patterns, with surfaces of each collar being engaged with the complementary surfaces of the first pair portion of the elongated cutout patterns, and a second collar/pin assembly comprising a second pin having opposing ends, and a second pair of collars, each collar of the second pair having an eccentric bore configured to removably receive an associated end of the second pin and having surfaces configured to engage complementary surfaces of the second pair portion of the elongated cutout patterns, the second pin extending between the first and second ear plates and within the second pair portion of the elongated cutout patterns, with surfaces of each collar of the second pair being engaged with the complementary surfaces of the second pair portion of the elongated cutout patterns, wherein the first and second collar/pin assemblies are configured such that a center distance between the first pin and second pin can be adjusted in large increments by moving either one or both of the first and second collar/pin assemblies within the respective pair portion of the elongated cutout patterns, and wherein first and second pairs of collars are configured such that the center distance between the first pin and second pin can be adjusted in small increments by axial rotation of a pair of collars about a respective pin of one or both of the collar/pin assemblies.

2. The mounting structure of claim 1, wherein each of the collars of each of the first and second pairs of collars has a polygonal shaped portion and each of the first and second pair portions of the elongated cutout patterns have a plurality surfaces configured to receive and lock with surfaces of the polygonal shaped portion.

3. The mounting structure of claim 2, wherein each polygonal shaped portion is a hexagonal portion and each of the first and second pair portions of the elongated cutout patterns have the plurality generally sawtooth shaped surfaces configured to receive and lock with surfaces of the horizontal portion.

4. The mounting structure of claim 2, wherein each collar further includes an endcap with the eccentric bore extending therethrough receiving an associated pin, each endcap being adjacent to an external surface of an associated ear plate, each end of each pin having a bore therethrough disposed transversely with respect to an axis of the pin, a fastener being received in each pin bore so as to limit axial movement of each collar/pin assembly due to engagement of an endcap with an associated external surface.

5. The mounting structure of claim 4, wherein the fastener is a bolt secured with a nut.

6. The mounting structure of claim 1, further comprising:

a first support member fixed to the first ear plate and having first and second elongated cutout patterns corresponding to the first and second elongated cutout patterns of the first ear plate, and a second support member fixed to the second ear plate and having first and second elongated cutout patterns corresponding to the first and second elongated cutout patterns of the second ear plate.

7. The mounting structure of claim 1, wherein the at least one elongated cutout pattern comprises first and second individual and separated elongated cutout patterns in each ear plate.

8. The mounting structure of claim 1, wherein the base includes mounting members configured for removably mounting the mounting structure to an attachment or implement.

9. The mounting structure of claim 1, further comprising a bridge plate extending between and fixed to the first and second ear plates.

10. The mounting structure of claim 1, wherein each collar includes a position indicator to aid in orientation thereof.

11. A method of changing a centerline distance between pins of a mounting structure used for changing attachments or implements on a construction machine, the mounting structure comprising first and second ear plates mounted to a base and disposed in spaced relation, each ear plate including at least one elongated cutout pattern, the elongated cutout patterns of the first and second ear plates being aligned to define spaced first and second pair portions of the elongated cutout patterns; a first collar/pin assembly comprising a first pin having opposing ends, and a first pair of collars, each collar having an eccentric bore configured to removably receive an associated end of the first pin and having surfaces configured to engage complementary surfaces of the first pair portion of the elongated cutout patterns, the pin extending between the first and second ear plates and within the first pair portion of the elongated cutout patterns, with surfaces of each collar being engaged with the complementary surfaces of the first pair portion of the elongated cutout patterns; and a second collar/pin assembly comprising a second pin having opposing ends, and a second pair of collars, each collar of the second pair having an eccentric bore configured to removably receive an associated end of the second pin and having surfaces configured to engage complementary surfaces of the second pair portion of the elongated cutout patterns, the second pin extending between the first and second ear plates and within the second pair portion of the elongated cutout patterns, with surfaces of each collar of the second pair being engaged with the complementary surfaces of the second pair portion of the elongated cutout patterns, the method comprising the steps of:

adjusting the centerline distance between the first and second pins by moving at least one of the first and second collar/pin assemblies within the respective pair portion of elongated cutout patterns, securing the first and second collar/pin assemblies with respect to the first and second endplates.

12. The method of claim 11, wherein the adjusting step further comprises:

axial rotating a pair of collars about a respective pin of at least one of the collar/pin assemblies to change a location of the eccentric bores and thus further adjust the centerline distance between the first and second pins.

13. The method of claim 11, wherein the adjusting step includes moving both of the first and second collar/pin assemblies within the respective pair portion of the elongated cutout patterns.

14. The method of claim 11, wherein the adjusting step includes axial rotating a pair of collars about a respective pin of both of the collar/pin assemblies.

15. The method of claim 11, wherein each of the collars of each of the first and second pairs of collars has a polygonal shaped portion and the at least one elongated cutout pattern has a plurality surfaces configured to receive and lock with surfaces of the polygonal shaped portion.

16. The method of claim 15, wherein each polygonal shaped portion is a hexagonal portion and the at least one elongated cutout pattern has the plurality sawtooth shaped surfaces configured to receive and lock with surfaces of the horizontal portion.

17. The method of claim 16, wherein the adjusting step includes the ability to adjust the centerline distance between the first and second pins by moving the moving either one or both of the first and second collar/pin assemblies within the respective pair portion of the elongated cutout patterns in 40 mm increments.

18. The method of claim 11, wherein the base includes mounting members configured for removably mounting the mounting structure to an attachment or implement.

19. The method of claim 11, wherein each collar further includes an endcap with the eccentric bore extending therethrough receiving an associated pin, each endcap being adjacent to an external surface of an associated ear plate, each end of each pin having a bore therethrough disposed transversely with respect to an axis of the pin, wherein the securing step includes:

inserting a fastener in each pin bore so as to limit axial movement of each collar/pin assembly due to engagement of an endcap with an associated external surface.

20. The method of claim 11, wherein the eccentric bore is configured such that the centerline distance between the first and second pins can be adjusted in 10 mm increments upon rotating a pair of collars about a respective pin of a collar/pin assembly.

* * * * *